US005333562A

United States Patent [19]

LeMaire et al.

[11] Patent Number: 5,333,562

[45] Date of Patent: Aug. 2, 1994

[54] METHOD OF STITCHING A PIECE OF FABRIC, A PIECE OF FABRIC OBTAINED THEREBY, AND A COMPOSITE FIBER-MATRIX PIECE OBTAINED USING SAID PIECE OF FABRIC

[75] Inventors: Etienne LeMaire, Saint Medard En Jalles; Lucien Fantino, Merignac, both of France

[73] Assignee: Aerospatiale Societe Nationale Industrielle, Paris, France

[21] Appl. No.: 993,704

[22] Filed: Dec. 21, 1992

[30] Foreign Application Priority Data

Jan. 24, 1992 [FR] France ..... 92 00761

[51] Int. Cl.[5] ..... D05B 93/00

[52] U.S. Cl. ..... 112/262.1; 112/440

[58] Field of Search ..... 112/262.1, 410, 412, 112/415, 417, 429, 440, 430, 438, 197

[56] References Cited

U.S. PATENT DOCUMENTS

| | | | |
|---|---|---|---|
| 298,053 | 5/1884 | Bally et al. | 112/410 |
| 795,290 | 7/1905 | Lowry | 112/412 |
| 2,283,802 | 5/1942 | Gingher | 112/2 |
| 3,291,085 | 12/1966 | Levy | 112/262.1 |
| 3,322,868 | 5/1967 | Kruse et al. | 264/45 |
| 3,533,893 | 10/1970 | Hartstein | 112/410 X |
| 4,059,468 | 11/1977 | Bouillon | 156/93 |
| 4,080,915 | 3/1978 | Bompard et al. | 112/412 |
| 4,628,846 | 12/1986 | Vives | 112/262.1 |
| 5,038,693 | 8/1991 | Kourtides et al. | 112/440 |
| 5,047,289 | 9/1991 | Arano et al. | 428/221 |

FOREIGN PATENT DOCUMENTS

| | | |
|---|---|---|
| 0273391 | 7/1988 | European Pat. Off. . |
| 2704378 | 2/1977 | Fed. Rep. of Germany . |
| 2315562 | 12/1977 | France . |
| 2159460 | 12/1985 | United Kingdom . |

*Primary Examiner*—Peter A. Nerbun
*Attorney, Agent, or Firm*—Fisher, Christen & Sabol

[57] ABSTRACT

A method of stitching a piece of fabric by means of a thread made of technical fiber, for the purpose of making a composite fiber-matrix piece. According to the invention: the needle thread is constituted by a flexible thread that is strong in traction; the shuttle thread is constituted by the thread of technical fiber; and the tension of the shuttle thread and the tension of the needle thread are respectively adjusted to a level that is sufficiently low and a level that is sufficiently high to ensure that after the stitch has been made, the shuttle thread projects outside the piece of fabric from the first face side thereof, and the needle thread lies completely outside the piece of fabric, likewise on the first face side thereof.

4 Claims, 1 Drawing Sheet

METHOD OF STITCHING A PIECE OF FABRIC, A PIECE OF FABRIC OBTAINED THEREBY, AND A COMPOSITE FIBER-MATRIX PIECE OBTAINED USING SAID PIECE OF FABRIC

The present invention relates to making reinforcement for the manufacture of composite fiber-matrix pieces having high mechanical and/or thermal performance.

BACKGROUND OF THE INVENTION

In manufacturing said composite pieces, it is known that fiber reinforcement is made which is then imprisoned in a settable matrix. Fibers suitable for use in making such fiber reinforcement are, for example, carbon fibers, boron fibers, glass fibers, aramide fibers, etc. Such fibers are designated below as "technical fibers ".

It is also known that when making such fiber reinforcement, stitching methods are often implemented using such technical fibers. For example, such stitching may be used:

- for assembling together individual fabric pieces to make up the desired reinforcement;
- for bending layers of superposed fiber material together to make up a fabric piece, from which reinforcement or a reinforcing element is subsequently made;
- for inserting fibers in a desired direction in a piece of fabric.

Stitching tests performed on such pieces of fabric using continuous threads made up of technical fibers and stitched by means of conventional sewing machines have been disappointing or completely impossible. Given the nature of technical fiber threads, they are damaged by the needle used for stitching them in said pieces of fabric, and this occurs to such an extent that they break frequently, thereby stopping the current stitching operation. Furthermore, the thicker the piece of fabric, the greater the frequency at which the stitching threads break, thereby making it impossible to stitch thick pieces of fabric.

In any event, even when a technical fiber thread does not break during stitching, it may break after stitching since a fragile zone is created at each stitch where the needle thread engages the shuttle thread.

Thus, to be able to stitch such a piece of fabric using a thread of technical fiber, it has been necessary to make stitching devices that are complex and/or that include a special support for the piece of fabric to be stitched, e.g. as described in documents U.S. Pat. Nos. 2,283,802 and 3,322,868.

An object of the present invention is to remedy this drawback and to allow pieces of fabric made of technical fibers to be stitched by means of threads likewise made of technical fibers, by using conventional sewing machines, and even when said pieces of fabric are thick.

SUMMARY OF THE INVENTION

To this end, the invention provides a method of stitching a piece of fabric with a thread of technical fiber for the purpose of making a composite fiber-matrix piece, in which method the stitching is performed with a needle thread and a shuttle thread crossing over in such a manner that, at each stitch, the needle thread is inserted in said piece of fabric by a needle which is driven with reciprocating motion and which, during its go stroke, passes through said piece of fabric, penetrating through a first face thereof and coming out through a second face opposite to the first, said shuttle thread then being engaged with said needle thread on said second face side, and then during the return stroke of said needle, the shuttle thread is pulled by said needle thread into said piece of fabric, the tensions of said shuttle thread and said needle thread being different; which method is remarkable in that:

- said needle thread is constituted by a flexible thread that is strong in traction;
- said shuttle thread is constituted by said thread of technical fiber; and
- the tension of the shuttle thread and the tension of the needle thread are respectively adjusted to a level that is sufficiently low and a level that is sufficiently high to ensure that after said stitch has been made, said shuttle thread projects outside said piece of fabric from the first face side thereof, and said needle thread lies completely outside said piece of fabric, likewise on said first face side thereof.

Thus, by means of the invention, the technical fiber thread cannot be broken or made fragile by the stitching needle. The technical fiber thread comes into contact only with the flexible needle thread which pulls it into the piece of fabric. It will be observed that the present invention goes against the knowledge of the person skilled in the art since it has always been the practice to use the thread with which it was desired to perform the stitching as the needle thread.

Because of the special adjustments of the tensions of the threads used in the present invention, only the technical fiber thread is imprisoned inside said piece of fabric. The flexible thread lies outside the piece of fabric and cannot therefore constitute a non-uniformity in said piece of fabric. Since such a flexible needle thread acts only as auxiliary means for pulling the shuttle thread made of technical fiber, it may be formed by any known thread having sufficient traction strength for performing its function. For example, it may be constituted by a known textile thread of natural or of synthetic fiber.

In addition, since it lies outside said piece of fabric, it is easily removed therefrom.

In addition, it will be observed that given the fibrous texture of said piece of fabric, the portions of technical fiber thread that lie inside the piece of fabric are held in place by the lateral pressure exerted by the other fibers of said piece of fabric. Consequently, it is possible, optionally, to eliminate those portions of technical fiber thread that appear on said first and second faces of the piece of fabric, without that damaging the strength of the stitches.

It is known that conventional sewing machines have tension-adjusting means for adjusting the tension of the stitching thread and braking means for braking the shuttle thread.

In order to obtain the "stitch" of the present invention, it may be necessary to provide additional means, such as baffles, thread-braking plates, etc. . . . , for increasing the tension of the needle textile thread to an appropriate value. In contrast, it may be necessary to reduce the tension applied to the shuttle thread by said braking means, e.g. by keeping the friction involved in operation thereof down to a minimum.

It may also be observed that it is advantageous for the sewing machine used in performing the method of the present invention to include, in conventional manner, a presser foot for engaging and guiding said piece of fabric in relative displacement past the needle, thereby enabling runs of stitches to be made. The presser foot exerts pressure on said piece of fabric and therefore compresses it. Such compression facilitates stitching in accordance with the invention and obtaining the desired thickness for said piece of fabric.

The present invention also provides a piece of fabric for use in making a composite fiber-matrix piece subjected to a stitching operation using a needle thread and a shuttle thread, and remarkable in that it includes technical fibers passing through it parallel to its thickness and formed by said shuttle thread.

The invention also provides a composite fiber-matrix piece made from such a piece of fabric by forming said matrix therein. Preferably, in said composite piece, said technical fibers are not connected to one another by portions of shuttle thread extending transversely to the thickness of said piece of fabric.

BRIEF DESCRIPTION OF THE DRAWING

An embodiment of the invention is described by way of example with reference to the accompanying drawing, in which.

DETAILED DESCRIPTION

In the figures, identical references designate items that are similar.

Figure 1:
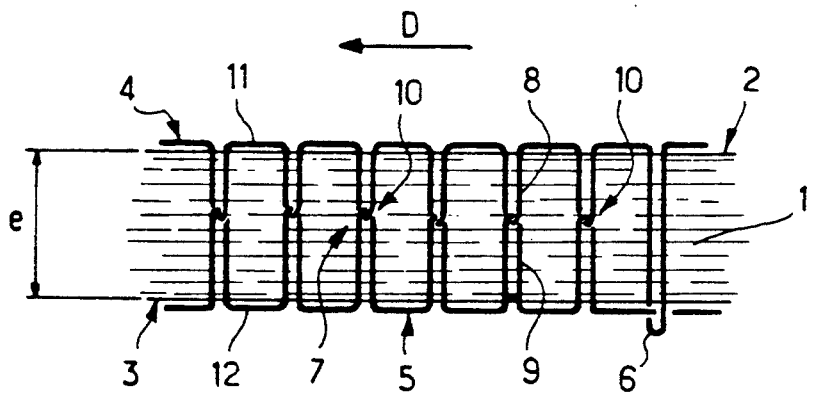
FIG. 1 is a diagrammatic section view through a piece of fabric and serves to illustrate how stitches can be formed in conventional manner in said piece of fabric using a needle thread and a shuttle thread.
Figure 2:
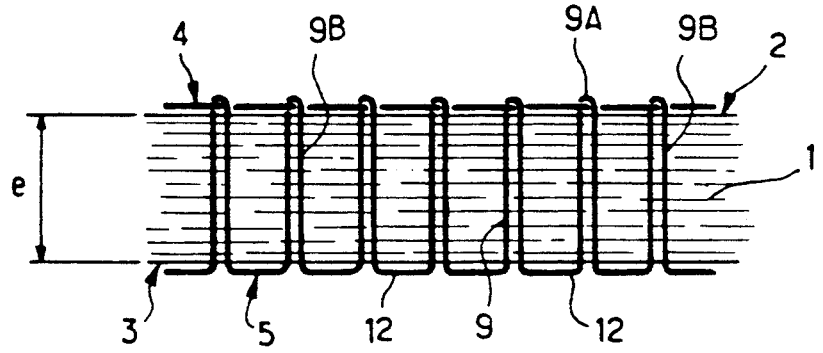
FIG. 2 is a diagrammatic section view analogous to FIG. 1 and showing stitches in accordance with the present invention.
Figure 3:
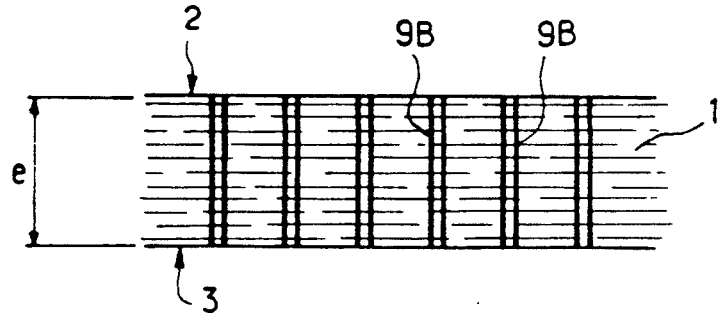
FIG. 3 is an analogous view of the piece of fabric of FIG. 2 after the portions of needle thread and shuttle thread lying outside said piece of fabric have been eliminated.

The piece of fabric 1 shown in FIGS. 1 to 3 is made of technical fibers (carbon, glass, aramide, boron, etc. . . . ) and it has opposite faces 2 and 3. It may be in the form of a woven cloth, optionally impregnated with a settable resin, or it may be in the form of a mat in which fibers that are dry or that are pre-impregnated with settable resin are disposed in an organized manner in two or more determined directions, or else are distributed randomly. The piece of fabric 1 may even be constituted by a plurality of superposed individual layers.

FIG. 1 is a diagram showing the process of stitching said piece of fabric 1 by means of a needle thread 4 coming from a reel via tension-adjusting means, and a shuttle thread 5 coming from a spool via braking means for braking the thread. In order to clarify the figure, the needle, the shuttle, the reel of needle thread, the spool, said tension-adjusting means, and said braking means are not shown. In addition, it is assumed that relative displacement movement exists between the needle and the piece of fabric 1, with said relative displacement being represented by arrow D.

Thus, as shown diagrammatically at the righthand end of FIG. 1, the needle through which the needle thread 4 passes penetrates into the piece of fabric 1 through the face 2 thereof, passes through said piece of fabric parallel to its thickness e, and projects beyond the face 3, where it forms a loop 6 of needle thread 4. The shuttle disposed adjacent to the face 3 and containing the spool of shuttle thread 5 then passes through the loop 6. Once the shuttle thread 5 has thus gone through the loop 6, the needle is raised, pulling its own needle thread 4 with it, thereby tightening the loop 6 which imprisons the thread 5 from the shuttle and pulls it by means of the needle thread 4. This process is repeated all along a line of stitches because of the relative displacement movement D. A run of stitches 7 is thus obtained.

In each completed stitch 7, the needle thread 4 and the shuttle thread 5 form respective loops 8 and 9 that engage each other and form a point of contact 10 between the needle thread 4 and the shuttle thread 5.

Conventionally, the tension-adjusting means for the needle thread 4 and the braking means for the shuttle thread 5 are adjusted so that the points of contact 10 lie within the thickness of the piece of fabric 1, as shown in FIG. 1.

The various stitches 7 are then connected to one another by bridges 11 of needle thread and by bridges 12 of shuttle thread, said bridges 11 lying on the face 2 of the piece of fabric 1 while the bridges 12 lie on the face 3 thereof.

If it is desired to insert technical fibers into the piece of fabric 1 by stitching, and if continuous threads made of such technical fibers are used for this purpose as the needle thread 4 and as the shuttle thread 5, it is observed that the needle thread 4 breaks frequently, and the thicker the piece of fabric 1, the more often it breaks, thus making stitching impossible, in practice. In addition, in the stitches 7 achieved between two breaks in the thread, the needle thread 4 is made very fragile at the points of contact 10 such that said needle thread 4 often breaks at points of contact 10 after stitching.

According to the invention, to remedy this drawback and to enable technical fibers to be inserted into the piece of fabric 1 by stitching using an ordinary sewing machine:

- the needle thread 4 is selected to be a conventional textile thread that is strong in traction;
- the shuttle thread 5 is selected to be a thread of the technical fiber which is to be inserted in the piece of fabric 1;
- the tension in the needle thread 4 is adjusted to a high level by appropriately adjusting said tension-adjusting means, and optionally by providing further such means; and
- the tension of the shuttle thread 5 is adjusted to a low level by reducing the braking obtained by said braking means.

Thus, by appropriate adjustment of the tension in the needle thread 4 and in the shuttle thread 5 at respective high and low levels, the invention causes the following configuration to arise after a stitch has been completed (the stitch being made in the same way as explained above with reference to the righthand portion of FIG. 1):

- the loop 8 of the needle thread 4 disappears, said thread 4 lying in rectilinear manner on the face 2 of the piece of fabric 1; and
- the loop 9 of the shuttle thread 5, engaged with the thread 4, is pulled thereby until its end 9A (cooperating with the needle thread 4 while being pulled through the piece of fabric 1) projects above said face 2 of the piece of fabric 1.

As a result, there remain inside the piece of fabric 1 only the two branches 9B of each of the loops 9, while the thread 4 lies, tensioned, over the face 2 of the piece of fabric 1 and the face 3 thereof supports bridges 12. This is shown diagrammatically in FIG. 2.

The branches 9B of the loops 9 of shuttle thread 5 (thread made of technical fiber) are pressed and held in place inside the piece of fabric 1 by the fibers from which it is made. Consequently, as shown in FIG. 3, it is possible after stitching to eliminate the textile thread 4 from the face 2 together with the ends 9A of the loops 9 of shuttle thread 5, and/or to eliminate the bridges 12 of said shuttle thread 5 from the face 3 without spoiling the quality of the bond established through the piece of fabric 1 by the branches 9B, thereby installing technical fibers that extend transversely through the piece of fabric 1.

Such transverse fibers 9B can be used for assembling individual fiber layers of the piece of fabric 1 together (to form a thick fiber element or else to connect to together overlapping edges of two individual fiber elements), or else to form reinforcing technical fibers that extend parallel to the thickness of said piece of fabric 1.

If the sewing machine used for implementing the invention includes a presser foot in conventional manner for guiding the piece of fabric 1 as it moves in the direction D relative to the needle, it will be understood that the presser foot can be used to compress the fibers making up the piece of fabric 1 in a direction parallel to its thickness, thereby enabling its thickness to be adjusted and also facilitating the making of a stitch in accordance with the invention and as shown in FIG. 2.

Naturally, after stitching in accordance with the invention has been performed, the piece of fabric 1 may be subjected to any known matrix-impregnating and setting operations. It may also be observed that the thread 4, the ends 9A and/or the bridges 12 may be eliminated optionally after a composite-matrix piece has been obtained from the piece of fabric 1.

We claim:

1. A method of stitching a piece of fabric with a thread of technical fiber for the purpose of making a composite fiber-matrix piece, comprising, at each stitch, the steps of:

(a) inserting into said piece of fabric, by a needle, a needle thread constituted by a flexible thread that is strong in traction, said needle being driven with reciprocating motion and passing, during its go stroke, through said piece of fabric, penetrating through a first face thereof and coming out through a second face opposite to the first;

(b) engaging a shuttle thread of technical fiber with said needle thread on said second face side, and then during the return stroke of said needle, the shuttle thread is pulled by said needle thread into said piece of fabric to form a loop of the shuttle thread; and (c) adjusting the tension of the shuttle thread to a relatively low level, adjusting the tension of the needle thread to a relatively high level, pulling the loop of the shuttle thread until the end of the loop projects outside of the fabric on the first side thereof, simultaneously moving the needle thread until the needle thread lies completely outside of said piece of fabric on said first face thereof.

2. The method according to claim 1, wherein said flexible thread constituting the needle thread is a textile thread of natural or synthetic fiber.

3. The method according to claim 2, wherein said flexible thread constituting the needle thread is eliminated after said piece of fabric has been stitched.

4. The method according to claim 1, wherein the portions of the shuttle thread that appear on said first and second faces of said piece of fabric are eliminated after it has been stitched.

* * * * *